US005531409A

United States Patent [19]

Willow

[11] Patent Number: 5,531,409

[45] Date of Patent: Jul. 2, 1996

[54] FLANGE BEARING BOLTED RAIL FROG FOR RAILROAD TURNOUTS AND CROSSINGS

[76] Inventor: Robert E. Willow, 118 Warwick Dr. #70, Benicia, Calif. 94510

[21] Appl. No.: 391,213

[22] Filed: Feb. 21, 1995

[51] Int. Cl.[6] ..... E01B 7/10

[52] U.S. Cl. ..... 246/458; 246/463

[58] Field of Search ..... 246/457, 458, 246/460, 462, 463, 468, 472

[56] References Cited

U.S. PATENT DOCUMENTS

| | | | |
|---|---|---|---|
| 197,099 | 11/1877 | Cooke | 246/458 |
| 770,882 | 9/1904 | Whitehead | 246/458 |
| 812,877 | 2/1906 | Rankin | 246/458 |
| 1,067,699 | 7/1913 | Wertz et al. | 246/458 |

*Primary Examiner*—Robert J. Oberleitner
*Assistant Examiner*—S. Joseph Morano
*Attorney, Agent, or Firm*—Harris Zimmerman

[57] ABSTRACT

A bolted rail railroad frog designed to support a railroad wheel to roll through the frog on its flange rather than requiring its tread to jump across a flangeway gap. The frog is comprised of paired rail sections with a flangeway filler bar disposed therebetween to define a flangeway for the railroad wheel. Each flangeway filler bar has a ramped upper surface disposed to engage the wheel flange. Transition from the wheel riding on its tread to riding on its flange is accomplished by ramping both ends of the flangeway filler bars. When the wheel flange encounters the ramp it gradually lifts the wheel till the tread is clear of the top of rail and continues to carry the wheel over the flangeway gap and then rolls down the other ramp on the flange until the tread again is rolling on the top of the rail. A wheel riding through a frog on its flange rather than having its tread rolling across a flangeway gap will experience a much smoother ride due to the fact that the tread portion does not leap across open space at the flangeway gap. A significant aspect of the flange bearing bolted rail frog is that a primary component, the flangeway filler bars, is manufactured in standard sizes, and the flangeway filler bars are bolted in place in the crossing. This form of flange bearing crossing is adaptable to a wide range of crossing angles, and is quicker and cheaper to build and install than a flange bearing cast manganese frog.

4 Claims, 3 Drawing Sheets

FLANGE BEARING BOLTED RAIL FROG FOR RAILROAD TURNOUTS AND CROSSINGS

BACKGROUND OF THE INVENTION

The present invention relates to railroad frogs and more particularly to a rail frog designed to support a railroad wheel to travel through the frog on its flange rather than its tread.

During the period of modern railroading, whenever it was necessary for one rail to cross over another, as in a turnout or crossing, it was almost exclusively accomplished with a fixed point frog. Originally these frogs were fabricated basically of rail sections, flangeway filler bars and blocks bolted together. This fixed point frog requires the railroad wheel tread and flange to attempt to "jump" across the flangeway of the other rail; i.e., to traverse the intersecting flangeway gap without any support. As a result, each wheel delivers a severe impact to the small surface area of the point of the frog, generating great stress and wear at the point. The point of the frog has become a locus of maintenance and repair effort.

As the railroad tonnage increased it was necessary to develop frogs constructed wholly or partially of cast manganese. These frogs are much more expensive but have come into common usage because they can better resist the severe impacts imposed on the frog point. However, the flangeway gap with its inherent impacts still exist, causing passenger discomfort and damage to equipment, roadbed and the frog itself.

In an attempt to increase passenger comfort on light weight transit systems, designs for cast manganese frogs have been modified to allow wheels to pass over the flangeway gap by riding on their flanges. This is accomplished by diminishing the flangeway depth in the area of the gap to the point that the flange is not only riding upon it, but has lifted the tread slightly above the top of rail. The lifting is accomplished by ramping the flangeway from both ends. This design has been successfully used in transit railways but has not been tested under heavy railroad loads. The main problem with this design is its high cost, due to the fact that the entire transition typically is fabricated in cast manganese for strength and stability. Thus new blanks and molds must be made for each different angle of crossing, and each crossing is virtually a one-of-a kind installation formed of custom components.

SUMMARY OF PRESENT INVENTION

The present invention generally comprises a bolted rail railroad frog featuring flangeway filler bars which are conformed in such a manner to enable a railroad wheel to roll through the frog on its flange rather than requiring its tread to jump across a flangeway gap. This is accomplished by making the flangeway filler block high enough in the flangeway gap area to not only support the wheel on its flange, but to lift its tread slightly above the top of rail. Transition from the wheel riding on its tread to riding on its flange is accomplished by ramping both ends of the flangeway filler bars. When the wheel flange encounters the ramp it gradually lifts the wheel till the tread is clear of the top of rail and continues to carry the wheel over the flangeway gap and then rolls on the flange down the other ramp till the tread again is rolling on the top of the rail.

A wheel riding through a frog on its flange rather than having its tread rolling across a flangeway gap will experience a much smoother ride due to the fact that the tread portion is not made to leap across open space at the flangeway gap, avoiding severe impact on the point of the frog and damage to equipment, the roadbed and the frog. The flange bearing bolted rail frog thus produces a smoother transition, longer life and reduction in maintenance with minimum initial investment.

A significant aspect of the flange bearing bolted rail frog is that a primary component, the flangeway filler bars, is manufactured in standard sizes, and the flangeway filler bars are bolted in place in the crossing. This form of flange bearing crossing is adaptable to a wide range of crossing angles, and is quicker and cheaper to build and install than a flange bearing cast manganese frog.

DESCRIPTION OF THE PREFERRED EMBODIMENT

The present invention generally comprises a bolted rail railroad frog that supports a railroad wheel on its flange as it crosses the flangeway gap, yet is composed of standard components that are adaptable to virtually all rail crossing angles and configurations. Before describing the invention it is first necessary to review prior art railroad frogs so that the significant distinctions and advantages of the invention may be appreciated.

Figure 1:
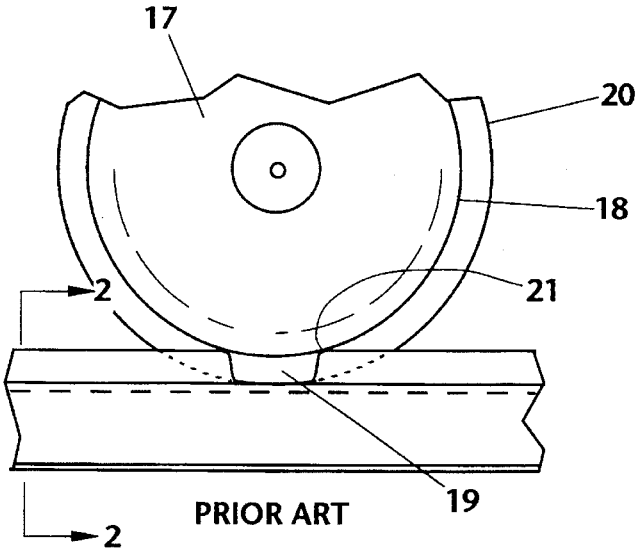
PRIOR ART Figure 1
FIG. 1 is a side elevation of a typical prior art bolted rail crossing frog, showing a typical railroad wheel traversing the crossing.
Figure 2:
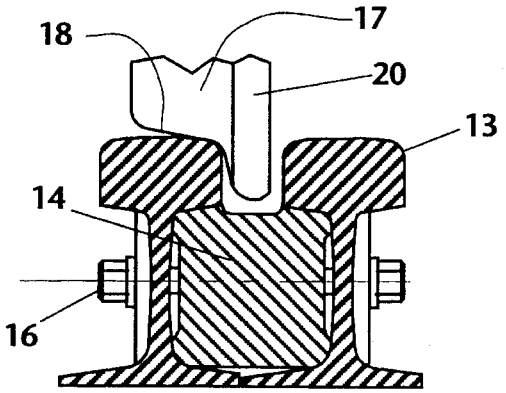
PRIOR ART Figure 2
FIG. 2 is a cross-sectional elevation showing a typical prior art rail crossing frog as in FIG. 1, taken along line 2—2 of FIG. 1.

During the period of modern railroading, whenever it was necessary for one rail to cross another rail, as in a turnout or crossing, it was almost exclusively accomplished with a fixed point frog. Originally these frogs were fabricated basically of rail sections 13, flangeway filler bars 14 and spacer blocks joined together with bolts 16 as shown in FIG. 2. This fixed point frog requires the railroad wheel 17, which has been riding on its tread 18 to attempt to "jump" across the flangeway gap 19 to the other rail. The wheel is unsupported for an instant before it lands on the far side of the flangeway gap, thus delivering a severe impact to the point of frog 21. Moreover, the point of the frog has a small surface area, and the stress and wear on the frog is magnified. These impacts cause severe damage to the points of fogs as well as to the rolling stock and roadbed resulting in high maintenance and premature replacement.

As railroad tonnage increased it was necessary to develop frogs constructed wholly or partially of cast manganese. These frogs are much more expensive, but they have come into common usage because they are much more able to resist the severe impacts imposed upon them. However, the flangeway gap still exists with its inherent impacts causing damage to rolling equipment, the roadbed and the frog itself and well as passenger discomfort and jarring of cargo.

Figure 3:
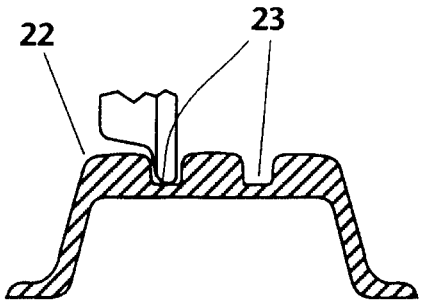
PRIOR ART Figure 3
FIG. 3 is a cross-sectional elevation of a typical prior art flange bearing cast frog for a railroad crossing.
Figure 4:
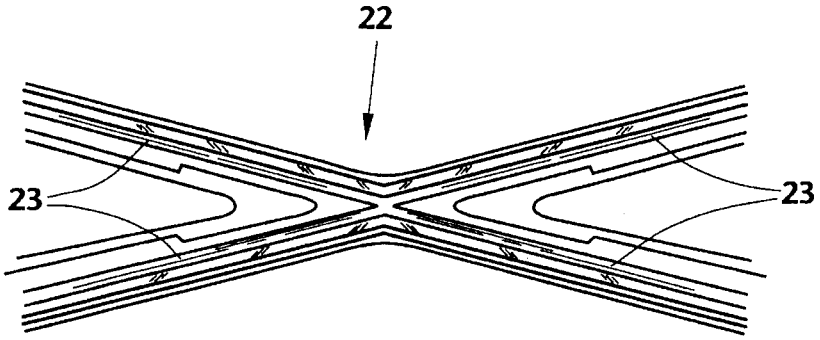
PRIOR ART Figure 4
FIG. 4 is a plan view of the prior art cast frog depicted in FIG. 3.
Figure 5:
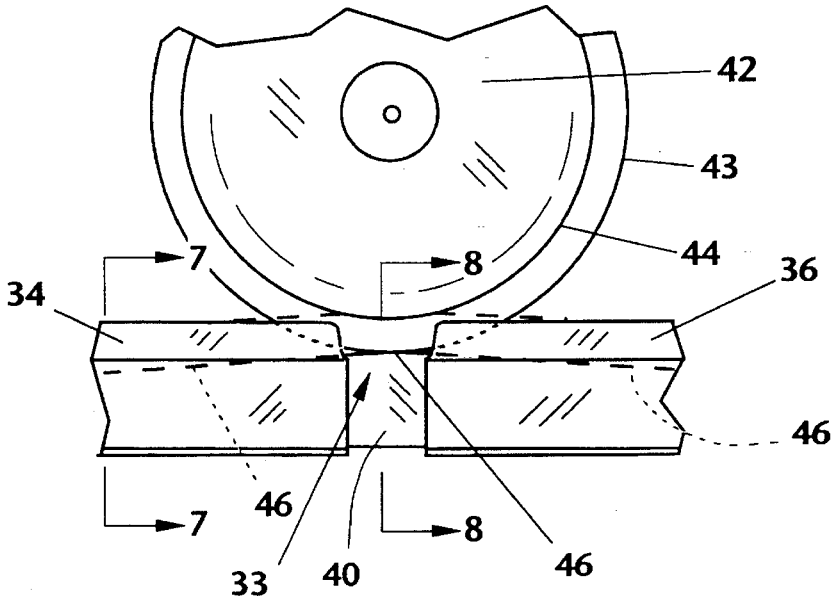
FIG. 5 is a side elevation of the flange bearing bolted rail frog assembly of the present invention, showing a typical railroad wheel traversing the crossing.
Figure 6:
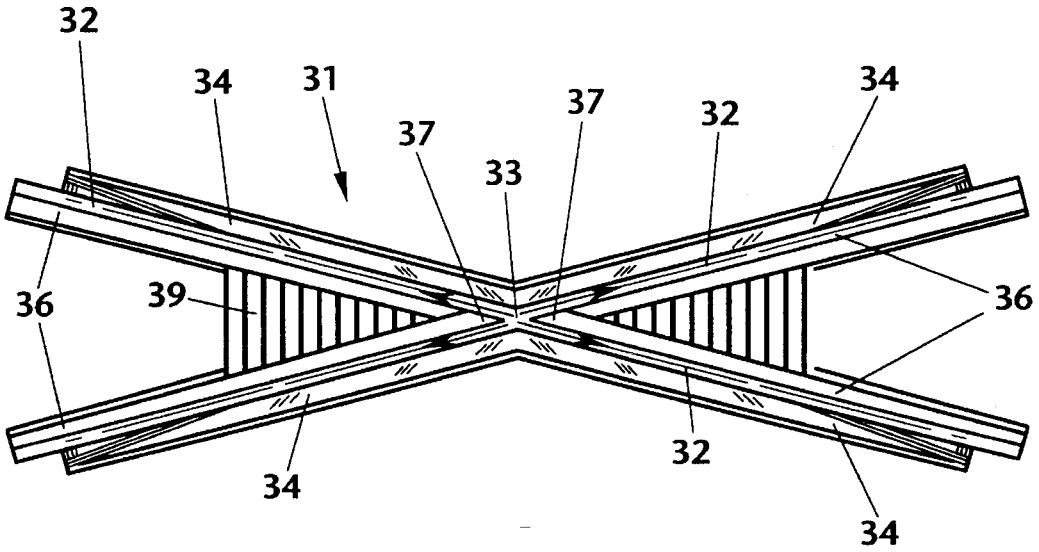
FIG. 6 is a plan view of the flange bearing bolted rail frog assembly shown in FIG. 5.
Figure 7:
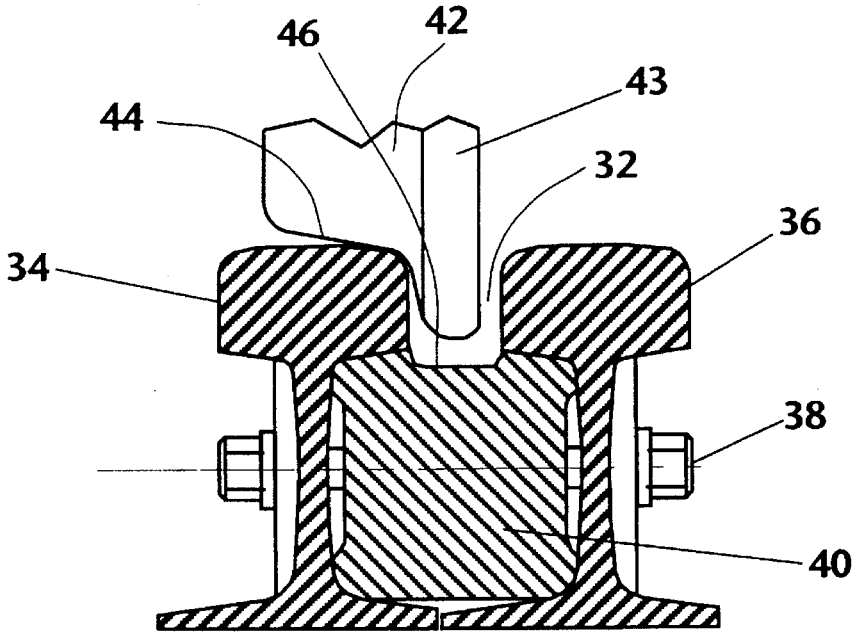
FIG. 7 is a cross-sectional elevation of the flange bearing bolted rail frog assembly, taken along line 7—7 of FIG. 5.

In an attempt to increase passenger comfort on light weight transit systems, designs for cast manganese frogs have been modified. In these new frogs 22 the wheels pass over the flangeway gap by riding on their flanges 20 as shown in FIG. 3. This is accomplished by decreasing the depth of the flangeway 23 in the area of the flangeway gap, so that the flange 20 is not only riding on the bottom of the flangeway, but it has lifted the tread 18 slightly off of the top of rail. The lifting is accomplished by ramping the bottom of the flangeway 23 from both ends. This design has been successfully used in light weight transit railways, but has not been tested under heavy railroad loads.

The main problem with this type of frog is it relies for its strength and wear resistance on the fact that it is a unitary casting of highly durable material. However, new blanks and molds must be made for each different angle of crossing, resulting in high unit cost, long lead time for manufacturing, and shipping of the large finished components.

With reference to FIGS. 5–8, the present invention comprises a rail crossing 31 that combines the construction and cost advantages of a bolted rail frog with the smooth transition of a flange bearing rail crossing. The crossing 31 includes four flangeways 32 radiating from a central flangeway gap 33. Each flangeway 32 is defined by an outer pair of standard rail sections 34 and an inner pair of standard rail sections 36, the inner sections converging toward the flangeway gap to define the points 37 of the frog. Each adjacent pair of sections 34 and 36 is spaced apart to define each of the flangeways 32. A flangeway filler bar 40 is disposed between the opposed paired sections 34 and 36 to maintain the desired spacing and proper flangeway width. The sections 34 and 36 and the filler bar 40 are joined together by bolts 38 extending transversely therethrough. Spacer blocks 39 extend between the converging rail sections behind each frog point 37.

Each filler bar 40 includes a generally rectangular cross-section, with opposed side surfaces disposed to engage the adjacent rail sections, holding the rail sections apart to define the flangeway 32. A typical railroad wheel 42 includes a wheel flange 43 and an annular tread 44. The flangeway filler bar includes an upper surface portion 46 extending longitudinally and medially therealong. The surface portion 46 is disposed to engage and support the wheel flange 43 as it traverses the flangeway gap 33. That is, the surface portion 46 tapers downwardly and outwardly, as indicated by the arrows in FIG. 6, from the gap 33.

Figure 8:
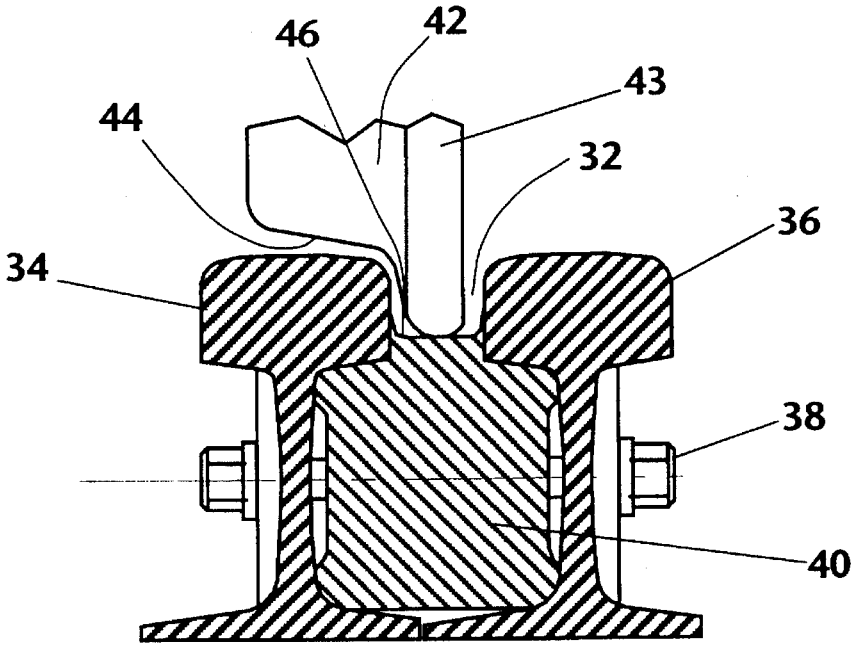
FIG. 8 is a cross-sectional elevation of the flange bearing bolted rail frog assembly, taken along line 8—8 of FIG. 5.

At the outer portion of the filler bar 40, in the area of the entrance to the crossing, the surface 46 is defined below the rail shoulder to create clearance for the wheel flange 43. The surface 46 ramps upwardly toward the flangeway gap 33 to engage the wheel flange gradually and lift the tread off the rail before the gap 33 is traversed, as shown in FIG. 8. Thus the wheel is supported on its flange as the gap 33 is crossed, and the impact on the point 37 is eliminated. The wheel 42 makes a soft landing as the rolling tread gradually reengages the rail section 36 at a very shallow angle. The jolt felt by passengers at rail crossings is noticeably reduced, and stress and wear on the frog points 37 is greatly diminished.

The construction of the present invention is generally unchanged whether the frog is used in a railroad turnout or railroad crossing.

It is significant that the flange bearing bolted rail frog described herein is easily constructed at virtually any rail crossing. The rail sections and flangeway filler bars bearing the ramped surface 46 may be fabricated in standard sizes and lengths, and assembled in the field as required by the site plan. The modular components are widely adaptable to crossings and turnouts of a wide range of angles, thus achieving an economy of scale that is not possible with prior art cast rail crossing frogs.

The flange bearing bolted rail frog has many advantages over prior art fixed point frogs, which are summarized as follows:

1. As opposed to common fixed point frogs:

a. it does not impose severe impacts on the frog point.

b. it jars passengers and loads less.

c. it does not punish the rolling stock as severely.

d. it does not cause as much damage to the ballast and roadbed.

e. it would require less maintenance.

f. it would last longer.

2. As opposed to flange bearing cast manganese frogs:

a. it requires less time to build.

b. it has a much lower cost.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

I claim:

1. A railroad frog, including;

a plurality of flangeways adapted to pass the flange of a railroad wheel, said plurality of flangeways radiating from a central flangeway gap;

each flangeway comprised of a pair of rail sections, a flangeway filler bar disposed between said pair of rail sections to define a flangeway spacing width therebetween, said flangeway filler bar extending from said flangeway gap to each longitudinally opposed end of said frog;

means for securing said rail sections and flangeway filler bar, including a plurality of bolts extending generally horizontally through the webs of said pair of rail sections and said flangeway filler bar disposed therebetween; and, each flangeway filler bar including upper surface means to engage the wheel flange of a railroad wheel and lift the wheel tread off said rail sections over said central flangeway gap, said upper surface means including an upper surface formed integrally and extending longitudinally on said flangeway filler bar and ramped downwardly and longitudinally along said flangeway from said central flangeway gap toward said longitudinally opposed ends of said frog.

2. The railroad frog of claim 1, wherein said bolts are spaced longitudinally along said rail sections.

3. The railroad frog of claim 1, wherein said flangeway filler bar includes opposed lateral surface portions disposed to impinge on respective adjacent rail sections to maintain a fixed flangeway spacing between said rail sections.

4. The railroad frog of claim 1, wherein said upper surface of said flangeway filler bar includes longitudinally opposed outer ends and is ramped from each outer end upwardly toward said flangeway gap to engage the flange of a wheel passing therealong in gradual fashion and lift the wheel tread from the rail to traverse said flangeway gap and make a soft landing as the wheel tread gradually reengages the rail section after crossing said flangeway gap.

* * * * *